US006126496A

United States Patent [19]

Shinozaki

[11] Patent Number: 6,126,496

[45] Date of Patent: Oct. 3, 2000

[54] SHORT-CIRCUITING TERMINAL

[75] Inventor: Tetsuya Shinozaki, Yokkaichi, Japan

[73] Assignee: Sumitomo Wiring Systems, Ltd., Japan

[21] Appl. No.: 09/309,596

[22] Filed: May 11, 1999

[30] Foreign Application Priority Data

May 14, 1998 [JP] Japan ..... 10-132348

[51] Int. Cl.[7] ..... H01F 4/48

[52] U.S. Cl. ..... 439/862

[58] Field of Search ..... 439/188, 372, 439/488, 489, 862; 200/284, 51.1, 51.09

[56] References Cited

U.S. PATENT DOCUMENTS

| | | | |
|---|---|---|---|
| 4,978,311 | 12/1990 | Oda et al. | 439/188 |
| 5,494,450 | 2/1996 | Kirsch et al. | 439/188 |
| 5,613,872 | 3/1997 | Fukuda et al. | 439/489 |
| 5,647,754 | 7/1997 | Kohno | 439/188 |
| 5,651,693 | 7/1997 | Fukuda et al. | 439/489 |
| 5,803,756 | 9/1998 | Furutani et al. | 439/188 |
| 5,863,216 | 1/1999 | Tsuji et al. | 439/489 |

*Primary Examiner*—Khiem Nguyen
*Assistant Examiner*—Brian S. Webb
*Attorney, Agent, or Firm*—Banner & Witcoff, Ltd.

[57] ABSTRACT

When two electrical connector housings are being fitted together, a locking arm 7 is bent, thereby bending a short-circuiting terminal 11 and bringing it into a non-contacting state with respect to a detecting terminal 8. When the fitting has been completed, the locking arm 7 returns to its original position, and the short-circuiting terminal 11 makes contact with the detecting terminal 8. This short-circuiting terminal comprises first spring members 15 and second spring members 16. The second spring members 16 have pressed members 16*b* which are pushed down by the locking arm 7, this causing driving members 16*c* to slide along the first spring members 15, thereby exerting a pressing force at a location closer to the contact members 15*b*. Improved travel of the short circuiting terminal 11 is thereby effected.

14 Claims, 6 Drawing Sheets

SHORT-CIRCUITING TERMINAL

TECHNICAL FIELD

The present invention relates to a short-circuiting terminal of an electrical connector.

BACKGROUND TO THE INVENTION

A prior electrical connector capable of detecting electronically whether male and female connector housings are in a correctly fitted state is described in JP-7-142122 (see FIG. 11 of this specification). This comprises: a connector housing 100 provided with an inclinable locking arm 101 and a short-circuiting terminal 102, which changes position when pushed by the locking arm 101. Another connector housing 103 is provided with a locking protrusion 104 and fitted with a detecting terminal 105. When the two connector housings 100 and 103 are being fitted together (a half-fitted state), the tip of the locking arm 101 is pressed down by the locking protrusion 104, the short-circuiting terminal 102 is thereby pushed and changes position and, as a result, the short-circuiting terminal 102 and the detecting terminal 105 do not make contact. When the two connector housings 100 and 103 are in a correctly fitted state, the locking arm 101 no longer experiences interference from the locking protrusion 104 and reverts resiliently to its original position. It then fits with the locking protrusion 104 to latch the connector housings 100 and 103. In addition, the resilient return of the locking arm 101 causes the short-circuiting terminal 102 to also revert to its original position and thereby make contact with the detecting terminal 105. That is, the fitted state can be detected by the presence or absence of an electrical circuit between the detecting terminal 105 and the short-circuiting terminal 102.

The detailed configuration of the short-circuiting terminal 102 is as follows. It is bent over at one end to form a U-shaped fulcrum 102*a*, and the other end has free edge and protrudes upwards to form a driven member 102*c*. The driven member 102*c* approaches the vicinity of the lower face of the locking arm 101. The anterior section of the rising portion of the driven member 102*c* forms a contact member 102*d* which makes contact with the detecting terminal 105.

The bending of the locking arm is used to detect whether the connector housings of the fitting detecting connector are in a fitted state. As a result, it is desirable that the short-circuiting terminal function performs in such a manner so as to reliably ensure that the short-circuiting terminal and the detecting terminal no longer make contact if the locking arm has bent and changed position even slightly, thereby reliably reflecting the movement of the locking arm, and clearly indicating whether the short-circuiting terminal and the detecting terminal are in contact.

However, in the configuration described above, the short-circuiting terminal 102 is bent towards the free end of the fulcrum 102*a*, and the contact member 102*d* and the driven member 102*c* are aligned with respect to each other. Consequently, the movement of the contact member 102*d* will necessarily be less than that of the driven member 102*c*. As a result, in a state when an adequate bending stroke of the locking arm is not maintained, the detecting function may be compromised. For example, comparatively large bending can be maintained in the case where the locking arm 101 has a cantilevered beam shape, but water-proof connectors often use see-saw-like locking arms. These see-saw locking arms have a small bending range, and the problem with the detecting function remains unresolved.

The present invention has been developed after taking the above problem into consideration, and aims to present a short-circuiting terminal and a fitting detecting connector having the terminal attached therein in which the detecting function is improved.

SUMMARY OF THE INVENTION

According to the invention there is provided a resilient terminal for a short-circuiting electrical connector and comprising a base having arms upstanding from both ends thereof, said arms being directed towards each other and overlapping, wherein the lower arm defines a contact for electrical connection to a detecting terminal, and the upper arm includes one segment which is directed away from and towards said base, an upper portion of the upper arm comprising an abutment adapted to be urged towards said base on application of an external force, the base and another segment which is directed a lower portion of the upper arm being adapted to contact said lower arm for movement thereof. Such a terminal can give an improved range of movement over the prior arrangement.

Preferably the upper arm is adapted for sliding movement on the lower arm, and most preferably the free end of the upper arm is arcuate to make such contact smooth.

Two identical upper and lower arms may be provided. The base may include sidewalls and endwalls upstanding therefrom, and preferably the terminal is formed from a single metal blank.

A terminal according to the invention may be inserted into a chamber of a connector housing, the insertion opening also constituting an access opening for a latching arm of the connector, such that depression of said latching arm causes consequent movement of said upper and lower arms.

BRIEF DESCRIPTION OF DRAWINGS

Others features of the invention will be apparent from the following description of a preferred embodiment shown by way of example only in the accompanying drawings in which.

DESCRIPTION OF PREFERRED EMBODIMENT

Figure 1:
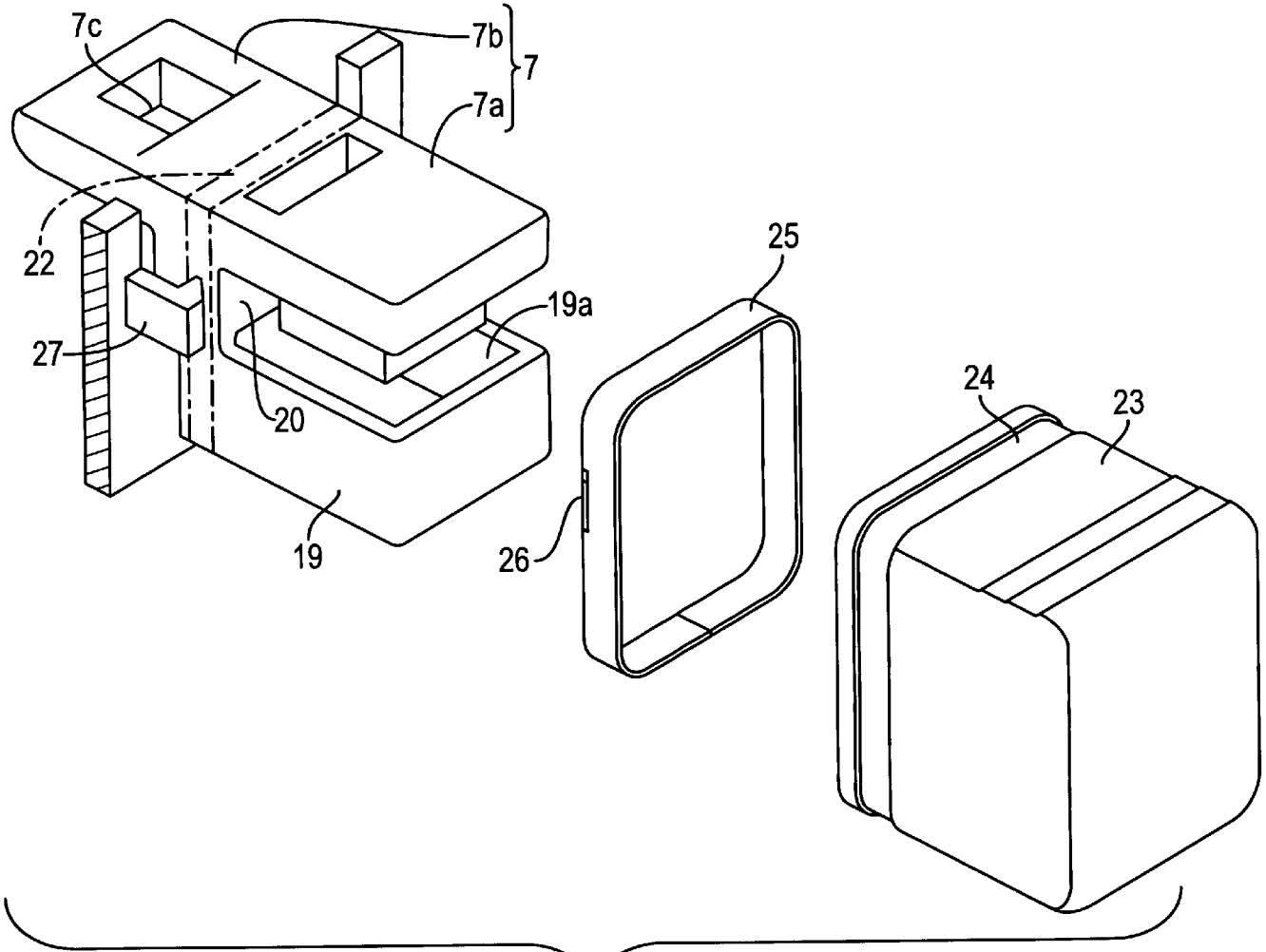
FIG. 1 is a diagonal view showing the circumference of a resilient sealing cover.
Figure 2:
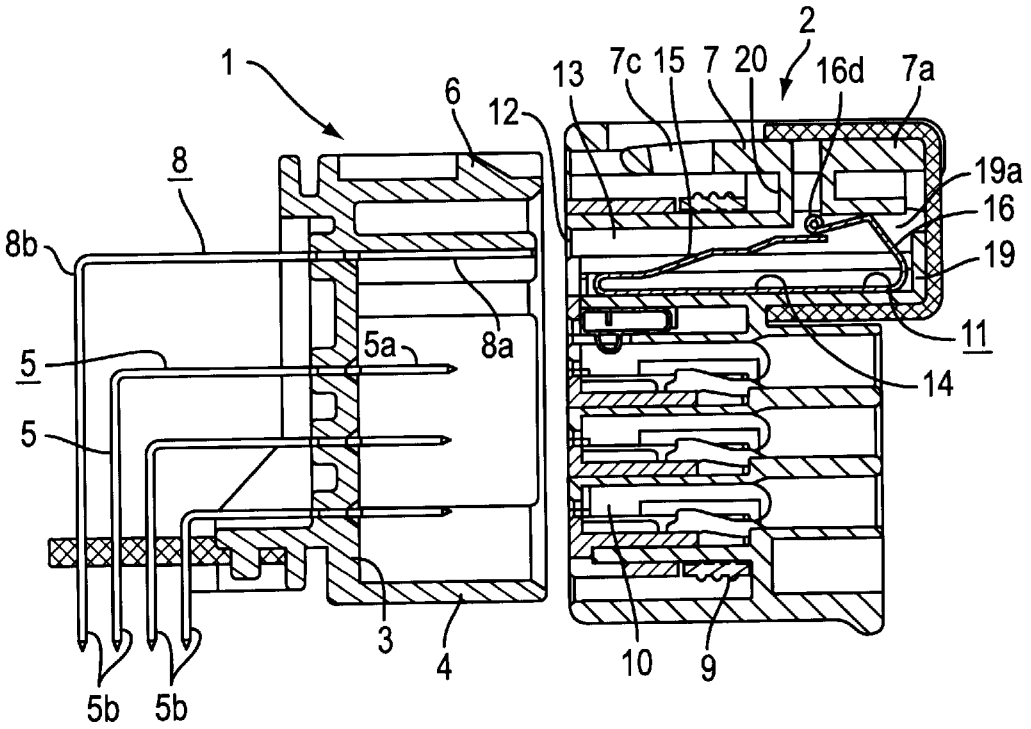
FIG. 2 is a cross-sectional view showing a state prior to fitting the connectors together.
Figure 3:
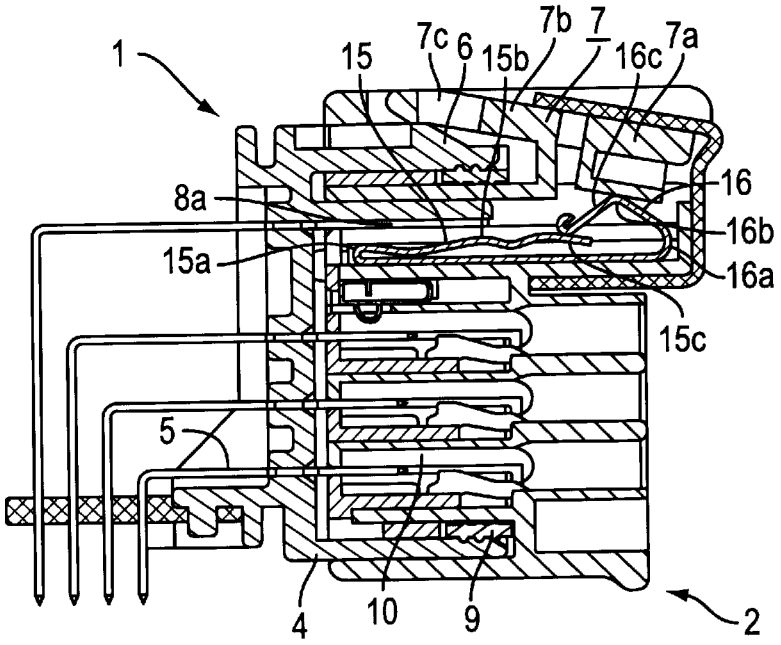
FIG. 3 is a cross-sectional view showing a state during the fitting operation.
Figure 4:
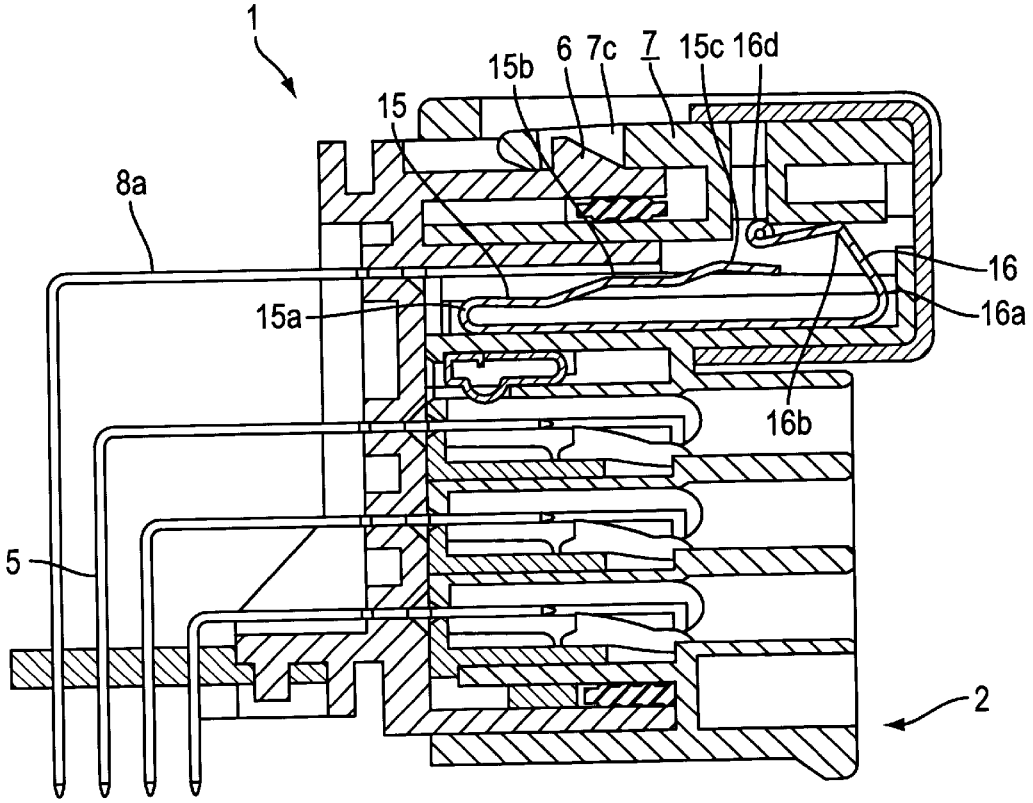
FIG. 4 is a cross-sectional view showing a state after fitting has been completed.

The present embodiment is explained below with the help of figures. A male housing 1 is provided on the left side of FIG. 2, and the right side shows a female housing 2.

The male housing 1 is made from plastic and has a hood 4 protruding in an anterior direction from a supporting wall 3, this hood 4 fitting with the female housing 2. L-shaped male terminal fittings 5 pass through the supporting wall 3. Joining members 5*a* of the male terminal fittings 5 are located in the hood 4, the other ends of the male terminal fittings 5 forming attachment members 5*b* which face downwards and are attached to a circuit board (not shown). The male housing 1 is attached, for example, to a water-proofed computer unit (not shown) of an automobile, the hood 4 protruding to the exterior. Further, the upper face of the hood 4 has a locking protrusion 6 which fits with a locking arm 7 when the hood 4 is fitted to the female housing 2. A pair of L-shaped detecting terminals 8 (one behind the other) pass through the supporting wall 3, detecting members 8*a* of the detecting terminals 8 extending in an anterior direction along the ceiling face of the hood 4, the other ends thereof forming attachment members 8*b* which are bent downwards from the posterior end of the supporting wall 3, these making contact with the circuit board.

The female housing 2 is made from plastic, a rubber sealing member 9 being attached to the outer circumference thereof. When the hood 4 is in a fitted state therewith, the section of the hood 4 fitting with the sealing member 9 is water-proofed. Female terminal fittings (not shown) are inserted from the posterior into cavities 10 of the female housing 2. The openings of these cavities 10 are water-proofed by rubber stoppers (not shown) attached to the female terminal fittings.

The anterior face of the upper portion of the female housing 2 has an insertion hole 12 and a terminal housing chamber 13. This terminal housing chamber 13 houses a short-circuiting terminal 11, which is inserted via the insertion hole 12. The short-circuiting terminal 11 is made in a unified manner from a thin metal sheet (for example phosphor bronze used for springs), and, as shown in FIG. 6, has a base plate 14 and a pair of first spring members 15 extending in a length-wise direction from one of the short ends thereof. These first spring members 15 are bent into a U-shape, and the bent-over portions form fulcrums 15*a* (see FIG. 5), metal-plated contact members 15*b* protruding from the peak of a portion that rises at a gentle slope from these fulcrums 15*a*. Pressure receiving faces 15*c* extend from the contact members 15*b*, these pressure receiving faces 15*c* first extending horizontally, then inclining upwards at the same slope as the contact members 15*b*, and then again extending horizontally. These pressure receiving faces 15*c* receive driving members 16*c* of second spring members 16. Further, the pair of second spring members 16 extend from the other of the short ends of the base plate 14, this pair of second spring members 16 being shorter in length than the first spring members 15. The second spring members 16 are bent at a greater angle than the first spring members 15, the bent portions thereof forming fulcrums 16*a* extending in the direction of the lower face of an operating member 7*a* of the locking arm 7. Hump like pressed members 16*b* are bent over at an angle of slightly greater than 90°, the uppermost portions thereof being pressed downwards by the locking arm 7. Moreover, the portions continuing on from the pressed members 16*b* form the driving members 16*c*, these driving members 16*c* pressing on the pressure receiving faces 15*c* of the first spring members 15 and overlap these first spring members 15 from above. The tips of the driving members 16*c* are folded over in an arc-shape to form folded members 16*d*, these folded members 16*d* allowing the driving members 16*c* to slide easily on the pressure receiving faces 15*c*.

Figure 5:
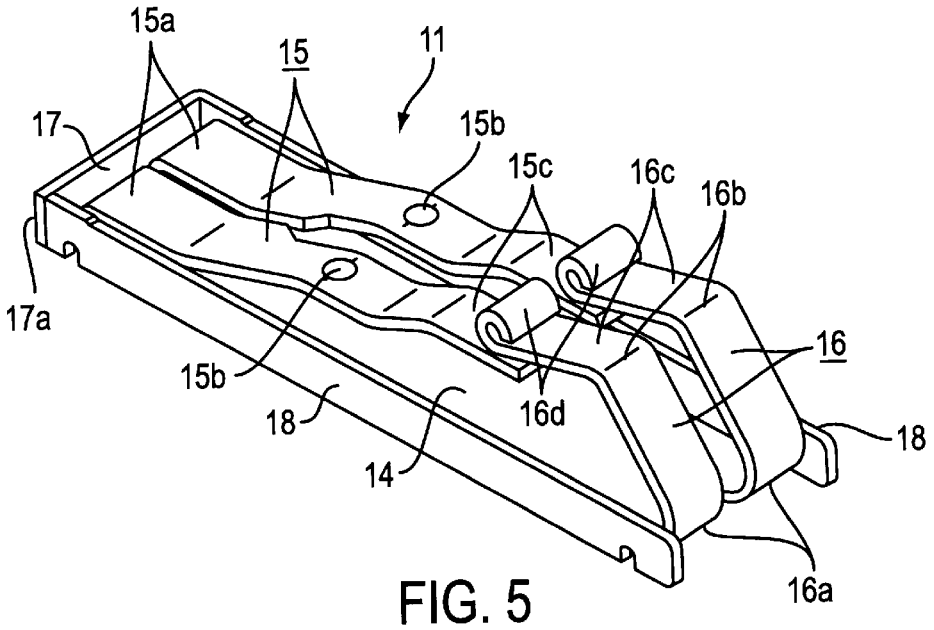
FIG. 5 is a diagonal view showing a short-circuiting terminal.
Figure 6:
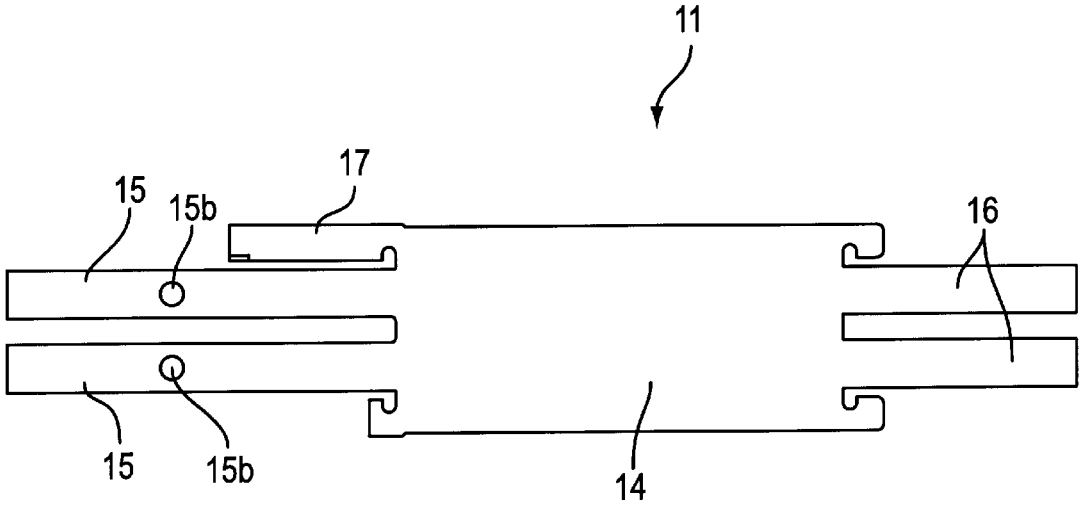
FIG. 6 is a developed view of the short-circuiting terminal.
Figure 7:
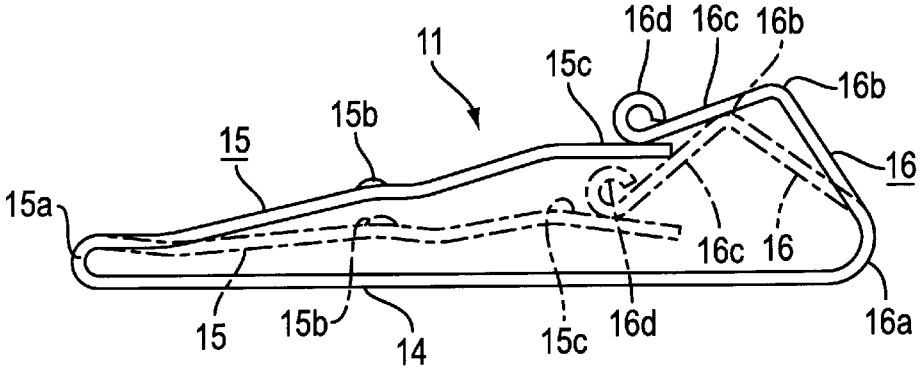
FIG. 7 is a front face view showing the movement of the short-circuiting terminal.

As shown in FIGS. 5 and 6, that end of the base plate 14 on which the first spring members 15 are provided has an operating member 17. This operating member 17 is bent at approximately a right angle so as to cover the anterior of the fulcrum portions of the first spring members 15 (FIG. 5). Furthermore, the anterior face of the operating member 17 forms an operating face 17*a* when the short-circuiting terminal 11 is pushed into the terminal housing chamber 13. Moreover, the two side edges of the upper face of the base plate 14 protrude upwards and form strengthening edges 18. The area of the terminal housing chamber 13 corresponding to the pressed members 16*b* has an opening 19*a* in the direction of the upper face of the female housing 2. Side walls and a lower face constituting this area protrude in a posterior direction from an upper end face which is located slightly towards the anterior side of the female housing 2. Moreover, the upper edge of a posterior side wall linking the posterior ends of the side walls forms an excessive bending prevention member 19, this preventing the locking arm 7 from exceeding its limit of resilience and thus undergoing plastic deformation.

A foot member 20 protrudes from the upper face of the female housing 2, this foot member 20 extending along the upper posterior side face and having the same width as the terminal housing chamber 13. The locking arm 7 is formed in a unified manner on the upper edge of the foot member 20, the locking arm 7 having the same width as the foot member 20, the anterior portion thereof having a stopping member 7*b*, and the posterior portion thereof having an operating member 7*a*. The stopping member 7*b* has a locking hole 7*c* capable of fitting with the locking protrusion 6 of the male housing 1. The operating member 7*a* is located so as to cover the top of the pressed members 16*b* of the short circuiting terminal 11. The locking arm 7 moves in a see-saw shape, bending the foot member 20 slightly, and causing the operating member 7*a* to move downwards.

While the male and female housings 1 and 2 are being fitted together, the operating member 7*a* is bent downwards so that the tip of the locking arm 7 does not make contact with the locking protrusion 6. The operating member 7*a* pushes down on the pressed members 16*b* of the second spring members 16 and consequently the pressure receiving faces 15*c* of the first spring members 15 are pushed downwards via the driving members 16*c*. The contact members 15*b* are also pushed downwards as a result, and the short circuiting terminal 11 is placed in a non-contacting state with respect to the detecting terminal 8. When the two housings 1 and 2 reach a correctly fitted state, the tip of the locking arm 7 is released from the locking protrusion 6, the locking arm 7 returns resiliently to its original position, and the locking protrusion 6 fits with the locking hole 7*c*, thereby latching the housings 1 and 2. Furthermore, as the locking arm 7 moves back to its orginal position, the operating member 7*a* stops pushing down on the pressed members 16*b* and the driving members 16*c* stop pushing down on the pressure receiving faces 15*c*. As a result, the first spring members 15 return resiliently to their original position, and the contact members 15*b* make contact with the detecting terminal 8, the detecting terminal 8 thereby becoming short-circuited. That is, the presence or absence of a short circuit in the short-circuiting terminal 11 allows one to determine whether or not the housings 1 and 2 are in a fitted state.

When the housings 1 and 2 are to be separated, the operating member 7*a* is pressed down, thereby releasing the locking hole 7*c* from the locking protrusion 6 and releasing the lock. The housings 1 and 2 can be pulled apart from this state.

Next, a means to prevent water or dirt from entering the terminal housing chamber 13 will be explained.

The outer side faces of the foot member 20 join, above and below, with the base end outer faces of the side walls so as to form a single face. The outer side faces of the foot member 20. the outer faces of the side walls, the upper side faces of the foot member 20, and the outer face of the lower face of the terminal housing chamber 13, all join together along their entire circumference to form a sealing circumference face 22 extending along the upper posterior end face.

The operating member 7*a* of the locking arm 7 and the posterior end portion of the terminal housing chamber 13 protrude to the posterior of this sealing circumference face 22. However, these protruding portions are covered from the posterior by a resilient sealing cover 23. This resilient sealing cover 23 has a box-shape open on its anterior face. The resilient sealing cover 23 is typically made of heat resistant and durable soft rubber, and the edge around the opening of the anterior face opens out somewhat resiliently and fits to the outside of the sealing circumference face 22. The resilient sealing cover 23 returns to its original shape after fitting, thereby tightly sealing the open end of the sealing circumference face 22. Furthermore a shallow attachment groove 24 is provided along the entire outer circumference of the open end of the resilient sealing cover 23, and a metal clamping ring 25 is fitted to the outside thereof. This clamping ring 25 is larger in size than the sealing circumference face 22, the difference in size being slightly less than the thickness of the resilient sealing cover 23. Consequently, the open end of the resilient sealing cover 23 is tightly clamped, from inside and outside, by the clamping ring 25 and the sealing circumference face 22, the open end of the resilient sealing cover 23 being pressed in tightly by these. As a result, the entire length of the sealing circumference face is sealed to a high degree, and water and dust are reliably prevented from entering the terminal housing chamber 13 or the operating member 7*a*.

Furthermore, stopping members 26 protrude diagonally in an outer posterior direction from the left and right side edges of the clamping ring 25, and hook-shaped receiving protrusions 27 are formed on the upper posterior side faces. The stopping members 26 fit with these receiving protrusions 27, thereby regulating the separation in a posterior direction of the clamping ring 25 and the resilient sealing cover 23. While the clamping ring 25 is being attached, the stopping members 26 bend inwards and move past the receiving protrusions 27 and then, having moved past these, the stopping members 26 move outwards as they return to their original shape, and fit with the receiving protrusions.

In the present embodiment, the short-circuiting terminal 11 comprises the first spring members 15 and the second spring members 16, and the pressed members 16*b* of the second spring members 16 are pressed by the operating member 7*a* of the locking arm 7. Thereupon the driving members 16*c* slide along and press down on a location closer to the contact members 15*b*. As a result, a greater degree of bending of the contact members 15*b* can be ensured, compared to the case of the prior example, in which the pressed members 16*b* press directly on the protruding contact members 15*b* (the pressed members 16*b* being pressed directly by the locking arm 7).

Figure 8:
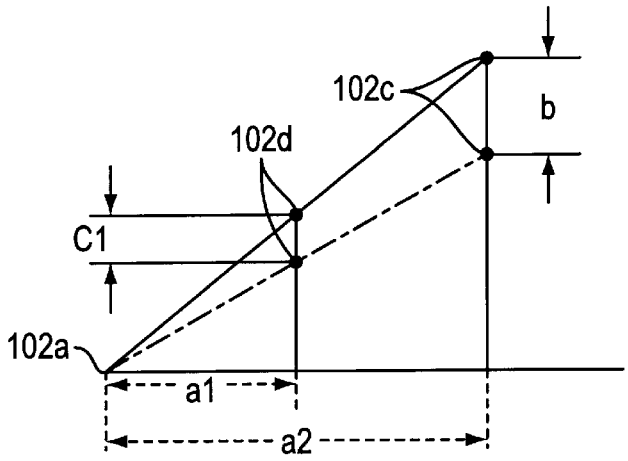
FIG. 8 (PRIOR ART)
FIG. 8 is a diagram schematically showing the bending of the short-circuiting terminal according to the example of FIG. 11.
Figure 9:
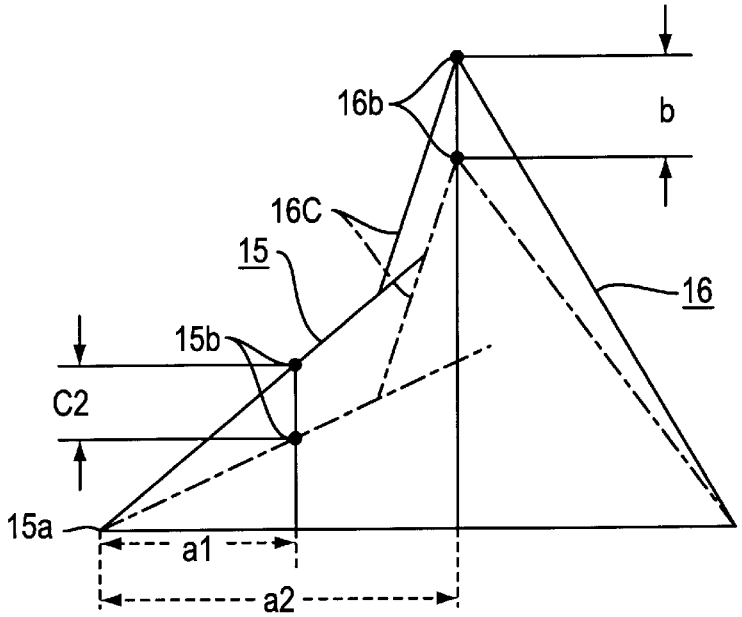
FIG. 9 is a diagram schematically showing the bending of the short-circuiting terminal according to the present invention.

FIG. 8 shows schematically the bending of the short-circuiting terminal in the prior example. When the driven member 102*c*, located at a horizontal distance a2 from the fulcrum 102*a*, is pushed down by the amount b, the contact member 102*d*, located at a horizontal distance a1 from the fulcrum 102*a*, is pushed down by amount c1. By contrast, FIG. 9 schematically shows the bending of the short-circuiting terminal in the present embodiment. As in FIG. 8, the horizontal distance between the fulcrum 15*a* and the contact member 15*b* is a1, and the horizontal distance between the fulcrum 15*a* and the pressed member 16*b* is a2. In FIG. 9, as in FIG. 8, the pressed member 16*b* is pushed down by the locking arm 7 by amount b, while the contact member 15*b* is pushed down by amount c2.

In this case, the pressed member 16*b* moves by the same amount as in FIG. 8. However, the driving member 16*c* pushes down the first spring member 15 at a location closer to the contact member 15*b*. Consequently, the height c2 showing the movement of the contact member 15*b* is greater than the height c1 in FIG. 8. That is c1<c2.

The movement of the contact member is increased compared to the prior example, and it can therefore be reliable distinguished if the detecting terminal 8 and the short-circuiting terminal 11 are making contact or not. The function of detecting whether the housings are fitted together is thereby improved. Further, the degree of bending of the contact member 15*b* is greater and, compared to the prior example, the bending stroke of the locking arm 7 can be decreased. As stated earlier, this factor is extremely valuable in a see-saw shaped locking arm often used in water-proof connectors.

As shown in FIG. 6, the short-circuiting terminal of the present embodiment is made from a single metal sheet by simply bending it. Manufacture is therefore simple.

Furthermore, when the locking arm 7 moves, the upper face portion of the sealing circumference face inclines slightly. However, the opening edge of the resilient sealing cover also inclines resiliently therewith, and therefore the seal is not damaged.

Figure 10:
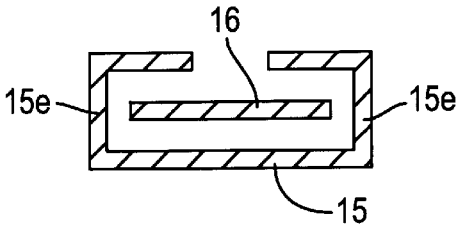
FIG. 10 is a cross-section through the terminal illustrating a retaining arrangement.
Figure 11:
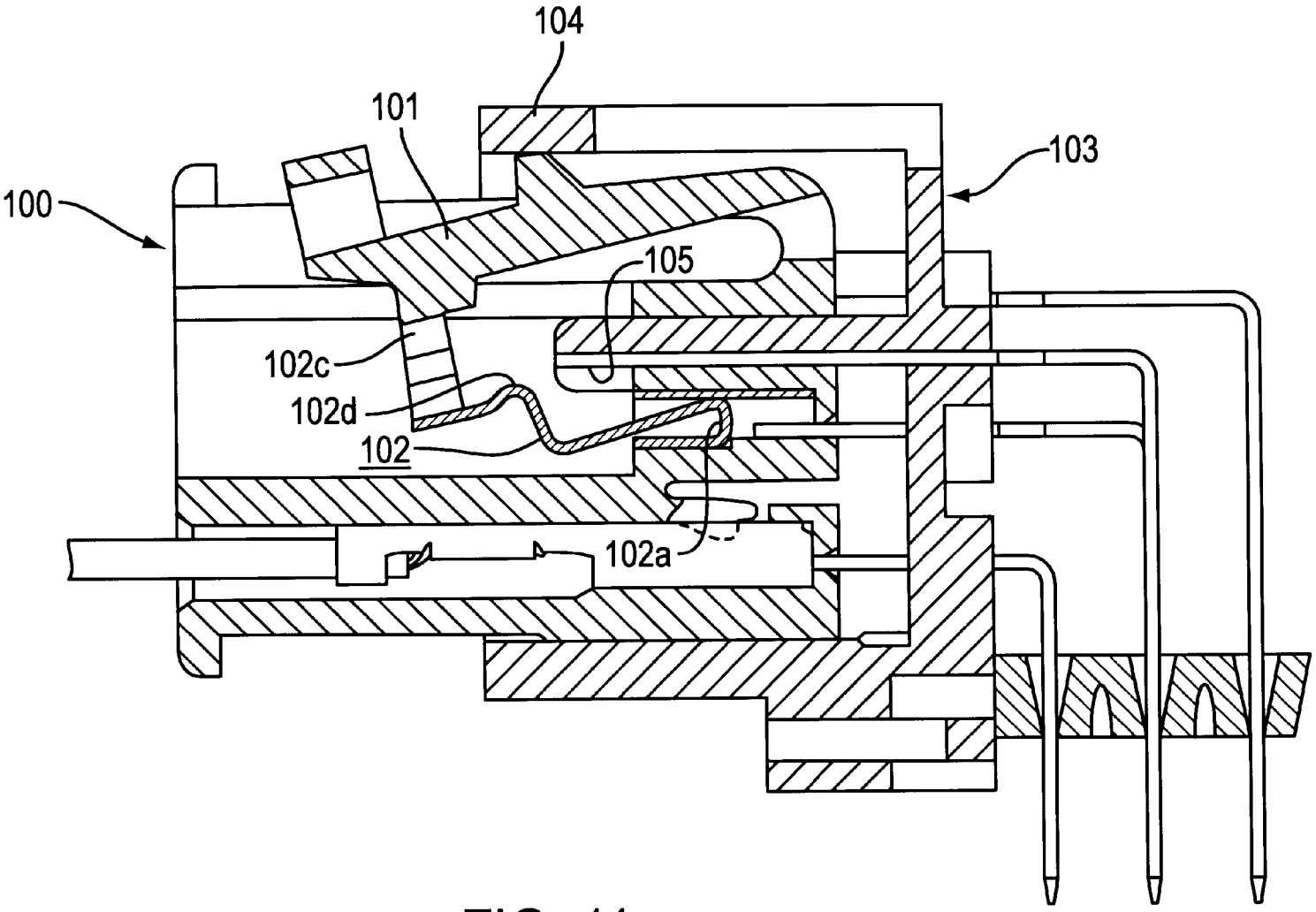
FIG. 11 (PRIOR ART)
FIG. 11 is a cross-sectional view showing a prior fitting detecting connector.

FIG. 10 illustrates an alternative arrangement in which an end portion of the lower arm 15 overlaps the upper arm 16 to an extent which permits a short retaining frame to be provided. As illustrated the lower arm 15 has upstanding limbs 15*e* which are directed towards each other at their ends to define an approximately rectangular frame surrounding the upper arm 16. With reference to FIG. 5 it is envisaged that the lower arm 15 would be extended in the region of the free end thereof, and the limbs 15*e* be formed on the free end for bending up and over the driving member 16*c* just next to the folded member 16*d*.

This prevents accidental bending of the free ends of the upper and lower arms 15,16 but does not inhibit relative movement because the frame is a rather loose fit. Similar limbs could alternatively depend from the upper arm 16 to define a frame encompassing the lower arm 15.

The present invention may be embodied in various other ways, and the possibilities descried below also lie within the technical range of the present invention.

(1) In the present embodiment, the short-circuiting terminal 11 is made from a single piece of sheet metal. However, the first spring members 15 and the second spring members 16 can also be made separately.

(2) Further, the tips of the driving members 16*c* need not be separate from the first spring members 15, but may also be joined therewith.

What is claimed is:

1. A resilient terminal for a short-circuiting electrical connector and comprising a base having arms upstanding from both ends thereof, said arms being directed towards each other and overlapping, wherein the lower arm defines a contact for electrical connection to a detecting terminal, and the upper arm is bent with segment which are directed away from and towards said base, an upper portion of the upper arm comprising an abutment adapted to be urged towards said base on application of an external force, and a lower portion of the upper arm being adapted to contact said lower arm for movement thereof.

2. A terminal according to claim 1 wherein said upper arm includes a free end which is adapted for contact with said lower arm, said free end sliding towards said contact on movement of said upper arm towards said base.

3. A terminal according to claim 2 wherein said free end and lower arm are retained together.

4. A terminal according to claim 3 wherein said lower arm includes upstanding arms on either side of said free end, said arms being bent over towards each other to define a retaining frame for said free end.

5. A terminal according to claim 2 wherein said free end is arcuate.

6. A terminal according to claim 1 and having two lower arms identical to each other and two respective upper arms identical to each other.

7. A terminal according to claim 1 and further including sidewalls upstanding from said base and extending in the direction of said arms.

8. A terminal according to claim 1 and further including an end wall upstanding from said base and extending transversely to the direction of said arms.

9. A terminal according to claim 8 wherein said end wall extends at right angles to the direction of said arms.

10. A terminal according to claim 8 or claim 9 wherein said lower arm includes a fulcrum which is adjacent to the end wall.

11. A terminal according to claim 1 wherein said terminal is folded from a unitary metal blank.

12. A terminal according to claim 1 and a housing thereof, said housing having a movable locking arm for engagement with a mating connector, said locking arm being adapted for contact with said abutment, thereby to move said upper arm.

13. A terminal according to claim 12 wherein said locking arm is pivotable in a see-saw manner, one end of the locking arm being for engagement with a mating connector, and the other end being for contact with said abutment.

14. A terminal according to claim 13 wherein said locking arm includes a finger operating pad at said other end.

* * * * *

UNITED STATES PATENT AND TRADEMARK OFFICE

CERTIFICATE OF CORRECTION

PATENT NO. : 6,126,496
DATED : October 3, 2000
INVENTOR(S) : Tetsuya Shinozaki

It is certified that error appears in the above-identified patent and that said Letters Patent is hereby corrected as shown below:

Column 7,
Line 1, replace “segment” with -- segments --.

Signed and Sealed this

Twenty-seventh Day of August, 2002

*Attest:*

*Attesting Officer*

JAMES E. ROGAN
*Director of the United States Patent and Trademark Office*